US010410545B2

(12) United States Patent
Probach et al.

(10) Patent No.: US 10,410,545 B2
(45) Date of Patent: Sep. 10, 2019

(54) PLATE HOLDER FOR HOLDING A LICENSE PLATE

(71) Applicant: Phoenix Contact GmbH & Co. KG, Blomberg (DE)

(72) Inventors: Nicole Probach, Blomberg (DE); Thomas Poelker, Horn Bad-Meinberg (DE); Patrick Oster, Lemgo (DE); Kilian Klages, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/555,521

(22) PCT Filed: Feb. 19, 2016

(86) PCT No.: PCT/EP2016/053524
§ 371 (c)(1),
(2) Date: Sep. 4, 2017

(87) PCT Pub. No.: WO2016/142149
PCT Pub. Date: Sep. 15, 2016

(65) Prior Publication Data

US 2018/0075784 A1 Mar. 15, 2018

(30) Foreign Application Priority Data

Mar. 6, 2015 (DE) ..... 10 2015 103 292

(51) Int. Cl.
*G09F 7/00* (2006.01)
*G09F 3/20* (2006.01)
(Continued)

(52) U.S. Cl.
CPC ..... *G09F 3/205* (2013.01); *G09F 3/20* (2013.01); *G09F 7/10* (2013.01); *G09F 7/18* (2013.01);
(Continued)

(58) Field of Classification Search
CPC ..... G09F 7/18; G09F 15/0012; G09F 2007/1843; G09F 1/10; G09F 1/12
See application file for complete search history.

(56) References Cited

U.S. PATENT DOCUMENTS 886,843 A * 5/1908 McLellan ..... G09F 23/00 229/125.12
2,101,965 A 12/1937 Trees
(Continued)

FOREIGN PATENT DOCUMENTS

DE 8708835 U1 9/1987
DE 19743405 A1 4/1999
(Continued)

*Primary Examiner* — Shin H Kim
(74) *Attorney, Agent, or Firm* — Leydig, Voit & Mayer, Ltd.

(57) ABSTRACT

A plate carrier for carrying a license plate includes: a carrier body; two guide rails that are arranged on the carrier body and extend so as to be mutually parallel, and between which the license plate can be pushed in an insertion direction in order to be arranged on the plate carrier, the license plate being held between the guide rails when arranged on the plate carrier; and at least one resilient latching element that is arranged on the carrier body and that can be deformed elastically when the license plate is being arranged on the plate carrier, and that secures the license plate on the carrier body against movement in the insertion direction when the license plate is arranged on the plate carrier.

16 Claims, 3 Drawing Sheets

(51) Int. Cl.
*G09F 7/10* (2006.01)
*G09F 7/18* (2006.01)

(52) U.S. Cl.
CPC ..... *G09F 2007/007* (2013.01); *G09F 2007/1839* (2013.01); *G09F 2007/1843* (2013.01)

(56) References Cited

U.S. PATENT DOCUMENTS 3,889,408 A * 6/1975 Offner ..... G09F 3/20 40/661.03
4,229,891 A * 10/1980 Keller ..... G09F 7/00 40/590
4,262,436 A * 4/1981 Clement ..... G09F 3/20 40/490
4,356,646 A * 11/1982 Johnson, Jr. ..... G09F 3/18 101/369
4,357,768 A * 11/1982 De Dube ..... G09F 3/20 40/653
4,376,348 A * 3/1983 Ackeret ..... A47G 1/143 40/513
4,958,452 A * 9/1990 Tate ..... A01K 11/001 119/655
5,012,602 A * 5/1991 Storey ..... B60R 13/105 40/201
5,052,081 A * 10/1991 Fuehrer ..... A44C 3/001 224/667
5,419,134 A * 5/1995 Gibson ..... G09F 1/10 248/223.41
5,592,767 A * 1/1997 Treske ..... G09F 3/207 24/3.11
6,050,014 A * 4/2000 Ohlson ..... A45C 11/182 206/37
6,427,836 B1 * 8/2002 Bolanos ..... A45C 11/182 150/148
6,564,488 B2 * 5/2003 Wittenberg ..... G09F 7/18 40/590
6,948,272 B1 * 9/2005 Olivier ..... G09F 7/18 40/331
7,228,651 B1 * 6/2007 Saari ..... A45F 5/004 224/162
7,308,771 B2 * 12/2007 Memelink ..... G09F 3/20 150/147
7,857,022 B2 * 12/2010 Kraml ..... A45C 11/182 150/147
7,877,909 B1 * 2/2011 Hagen ..... A01K 11/00 40/300
8,047,363 B2 * 11/2011 Sheba ..... A45C 11/18 206/307
8,225,538 B2 * 7/2012 Warren ..... A47G 25/1435 223/85
9,003,682 B2 * 4/2015 Garfinkle ..... G09F 7/10 40/606.01
D802,506 S * 11/2017 Bargen ..... D12/193
2007/0180747 A1 * 8/2007 Anzalone ..... G09F 7/18 40/765
2011/0079181 A1 * 4/2011 Craig ..... A01K 1/0017 119/416
2013/0318843 A1 * 12/2013 Nimtz ..... G09F 13/00 40/559
2018/0047312 A1 * 2/2018 Probach ..... G09F 7/10
2018/0075784 A1 * 3/2018 Probach ..... G09F 3/20

FOREIGN PATENT DOCUMENTS

DE 19847540 A1 4/2000
DE 202009004151 U1 7/2009
DE 202011000569 U1 6/2011
JP 2018507139 A 3/2018
WO WO 8302516 A1 7/1983

* cited by examiner (B-B)

(A-A)

(B - B)

PLATE HOLDER FOR HOLDING A LICENSE PLATE

CROSS-REFERENCE TO PRIOR APPLICATIONS

This application is a U.S. National Phase application under 35 U.S.C. § 371 of International Application No. PCT/EP2016/053524, filed on Feb. 19, 2016, and claims benefit to German Patent Application No. DE 10 2015 103 292.9, filed on Mar. 6, 2015. The International Application was published in German on Sep. 15, 2016 as WO 2016/142149 under PCT Article 21(2).

FIELD

The invention relates to a plate carrier for carrying a license plate.

BACKGROUND

A plate carrier of this kind comprises a carrier body and two guide rails that are arranged on the carrier body and extend so as to be mutually parallel, and between which a license plate can be pushed in an insertion direction in order to be arranged on the plate carrier. The guide rails extend in parallel with the insertion direction and are designed to receive the license plate therebetween such that the license plate is held between the guide rails when arranged on the plate carrier.

A plate carrier of this kind is used for example for identifying leads such as tubes, cables, pipes or the like. A license plate may in this case have lettering or another marking so that, by means of the license plate, a lead can be identified for example, or other information that is important for the operation of the lead or of an installation connected to the lead, for example, can be displayed on the lead.

In principle, a plate carrier can also be attached to other objects, for example in the industrial field.

In the case of plate carriers of this kind, there is a need for the license plate to be able to be attached to the plate carrier as simply as possible and to be held in a secure and reliable manner in a position arranged on the plate carrier. It is also desirable, in this case, for a license plate to be able to be released from the plate carrier again, as far as possible without using tools.

In the case of a plate carrier known from DE 197 43 405 A1, a license plate can be inserted between rails and is held between the rails when in position. By raising the license plate, the license plate can be released from the plate carrier, over a stop elevation.

In the case of a plate carrier known from DE 20 2011 000 569 U1, a plate is fastened to a carrier body by means of rivets.

SUMMARY

In an embodiment, the present invention provides a plate carrier for carrying a license plate, comprising: a carrier body; two guide rails that are arranged on the carrier body and extend so as to be mutually parallel, and between which the license plate is configured be pushed in an insertion direction in order to be arranged on the plate carrier, the license plate being held between the guide rails when arranged on the plate carrier; and at least one resilient latching element that is arranged on the carrier body and that is configured to be deformed elastically when the license plate is being arranged on the plate carrier, and that secures the license plate on the carrier body against movement in the insertion direction when the license plate is arranged on the plate carrier.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
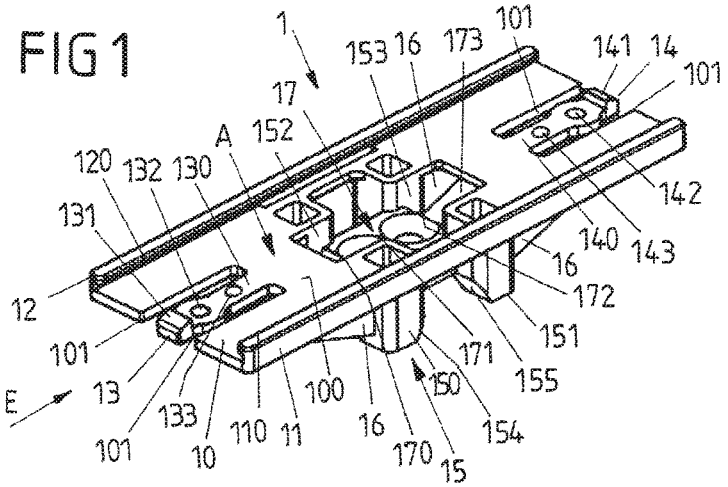
FIG. 1 is a perspective view of a plate carrier.

In an embodiment, the present invention provides a plate carrier that comprises at least one resilient latching element that is arranged on the carrier body and that can be deformed elastically when the license plate is being arranged on the plate carrier, and that secures the license plate on the carrier body against movement in the insertion direction when said license plate is arranged on the plate carrier.

Providing the resilient latching element makes it possible for a license plate, which may optionally be inherently rigid, to be placed in position on the plate carrier in a simple manner, and also for the license plate to be released from the plate carrier without using tools. In order to place a license plate in position on the plate carrier, the license plate is pushed between the guide rails. In this case, the license plate strikes the at least one latching element and forces said element aside in a resilient manner so that the license plate can be pushed over the latching element and into the plate carrier. When the license plate has achieved its specified fit on the carrier body, the latching element snaps back into the initial position thereof and comes into latching engagement for example with an edge of the license plate, so that the latching element secures the license plate on the carrier body against movement in the insertion direction.

A license plate can thus be placed in position on the plate carrier in a simple manner, by forcing aside the latching element, without the license plate needing to be deformed for this purpose. The fact that the latching element snaps into latching engagement with the license plate and thus captively secures said license plate on the plate carrier when the license plate has reached its specified position on the plate carrier, provides for a reliable hold of the license plate on the plate carrier.

In order to release the license plate from the plate carrier, the at least one latching element can be deformed such that the license plate is released so as to move in the insertion direction and can thus be pushed out of the plate carrier. The resilient deformation of the latching element can be carried out without using tools, by a user grasping the latching element by hand for example and pressing said element out of engagement with the license plate. It is thus not necessary to deform the license plate in order to release said plate from the plate carrier, and therefore rigid license plates that cannot easily be deformed can also be arranged on the plate carrier and released from the plate carrier again in a simple manner.

In an advantageous embodiment, the plate carrier comprises two latching elements that are arranged on the carrier body so as to be offset from one another in the insertion direction. In the position arranged on the plate carrier, the latching elements receive the license plate therebetween for example, in that a first latching element comes to rest against a first edge of the license plate that extends transversely to the guide rails, and a second latching element comes to rest against a second edge of the license plate that extends transversely to the guide rails, and the license plate is thus secured on the carrier body in a form-fitting manner in the insertion direction.

The carrier body comprises a support surface for example, which surface extends in a support plane and is used as a support for the license plate. By being pushed into the guide rails, the license plate is pushed onto the support surface such that the license plate rests in a planar manner on the support surface when arranged on the plate carrier.

In a specific embodiment, the at least one latching element is formed by a resilient web that is connected to the support surface. The web can be cut out of the support surface by means of slit-shaped openings for example, so as to result in a latching element in the manner of a snap-in tongue that can be moved towards the support surface in a resilient manner. A latching projection is preferably arranged on the at least one latching element, which projection rises above the support surface and thus provides a stop for the license plate. When the license plate is placed in position on the plate carrier, the license plate strikes the latching projection of the latching element and thus forces the latching element aside. When the license plate has reached its specified position on the plate carrier, the latching projection snaps into engagement with an edge of the license plate for example, such that the edge comes into contact with the latching projection and thus secures the license plate on the plate carrier against movement in the insertion direction.

The license plate is secured in a latching manner on the plate carrier by means of the latching projection, such that the license plate is prevented from being pushed out of its fit between the guide rails. In addition, the at least one latching element can comprise an elevation that projects from the support surface and that is designed to come into contact, when the license plate is arranged on the plate carrier, with an underside of the license plate that faces the support surface. The elevation can be rounded in a lenticular manner for example, so that the license plate can strike the elevation in a simple manner when being pushed into the plate carrier. When the license plate has been placed in position on the plate carrier, the elevation presses against the license plate from below and thus presses said license plate into contact with the guide rails, perpendicularly to the support surface, such that the license plate is held on the guide rails so as not to clatter and so as to have zero clearance.

Furthermore, a fastening point for fastening the license plate to the carrier body can be arranged on the at least one latching element. The fastening point can be designed for attaching a rivet or screw joint for example, so that, by means of the fastening point, the license plate can be additionally fastened to the plate carrier, by the latching connection provided by the at least one latching element, when said license plate has been placed in position on the plate carrier.

The plate carrier is used to arrange a license plate on a lead or on another object. For this purpose, the plate carrier can comprise a positioning apparatus for example, by means of which the plate carrier can be advantageously placed in position on a lead. A lead of this kind can be designed for example as a pipeline, as an electrical, pneumatic, hydraulic or another cable, or as another elongate lead. In this context, a lead is to be understood as any elongate element. For example, it can also be possible to place the plate carrier in position on a railing or on another elongate carrier by means of the positioning apparatus.

In one embodiment, the positioning apparatus comprises at least two positioning elements that project from the carrier body and the ends of which remote from the carrier body can be placed in position on the lead. The positioning elements can be peg-shaped for example, and are spaced apart from one another such that the lead comes to rest between the positioning elements when the plate carrier is placed in position.

In order to provide a precise hold together with favorable contact on the lead in this case, the positioning elements can for example each comprise a chamfer at the ends thereof remote from the carrier body, which chamfer comes into contact with the lead during positioning. The positioning elements are thus beveled on at least one edge in the region of the ends, such that each positioning element can come into contact with the lead by means of the chamfer, and a precise fit of the plate carrier on the lead is thus provided.

In a specific embodiment, the positioning apparatus can comprise four peg-shaped positioning elements for example, which elements extend so as to be mutually parallel and project from the carrier body. By means of the four peg-shaped positioning elements, the plate carrier can be placed in position on the lead for example in two different positions that are rotated by 90° with respect to one another, such that an elongate license plate can be arranged on the lead for example in parallel with an extension direction of the lead or transversely to the extension direction of the lead.

For this purpose, the positioning elements are preferably arranged relative to one another such that they together span a rectangle, preferably a square, when viewed in a cutting plane in parallel with the support surface. The positioning elements are thus arranged at corners of an, imaginary, rectangle. In this way, a lead can be received between the positioning elements in two different positions, in each case two positioning elements coming to rest on one side of the lead and the two other positioning elements coming to rest opposite, on the other side of the lead (reference is made to a center plane that is spanned by the longitudinal extension direction of the lead and a positioning direction in which the plate carrier is to be placed in position on the lead by means of the positioning apparatus).

If the positioning apparatus comprises four positioning elements that allow positioning on a lead in two different positions that are rotated by 90° with respect to one another, the positioning elements preferably each comprise two chamfers that are offset from one another such that a first chamfer comes into contact with the lead in a first position of the lead and, in contrast, a second chamfer comes into contact with the lead in a second position of the lead that is rotated by 90°. For this purpose, the chamfers are arranged at different edges, angled by 90° relative to one another, in the region of the end of each positioning element, such that the positioning element is beveled at two edges that extend at right angles to one another.

In order to secure the plate carrier on a lead, a fastening apparatus can be provided, which apparatus for example allows attachment of a fastening element in the form of a cable tie or the like. The fastening apparatus comprises at least one web, around which the fastening element, for example a cable tie, can be laid, in order to connect the plate carrier to the lead. In this case, the at least one web preferably comprises a chamfer and is thus beveled on at least one edge. The chamfer forms a contact surface for the fastening element so that the fastening element, for example a cable tie, can be laid around the web in a favorable manner and so as to be in low-wear contact with the chamfer.

Figure 2:
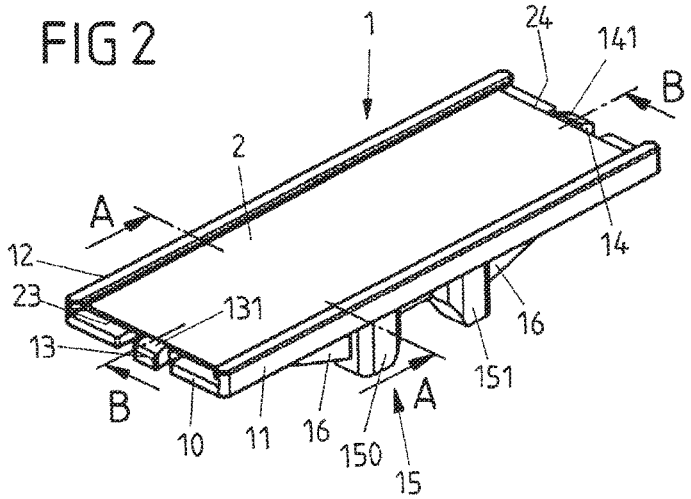
FIG. 2 is a perspective view of the plate carrier comprising a license plate arranged thereon.
Figure 3:
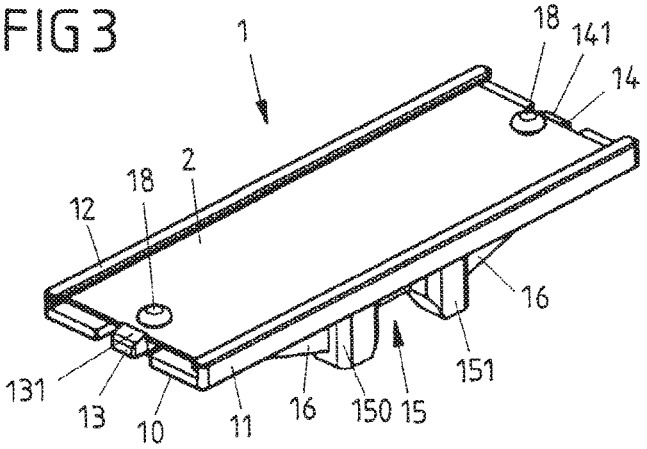
FIG. 3 is a perspective view of the plate carrier comprising a license plate arranged thereon, the license plate being additionally connected to the plate carrier by means of rivets.
Figure 4B:
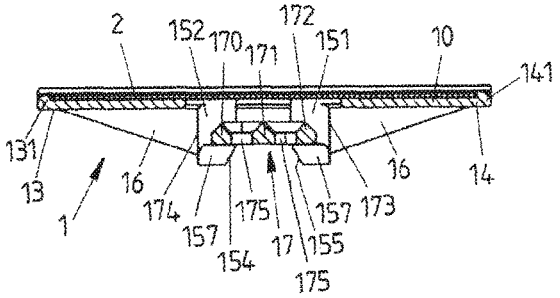
FIG. 4B is a cross section along the line B-B according to FIG. 2.
Figure 4A:
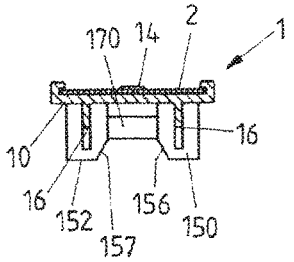
FIG. 4A is a cross section along the line A-A according to FIG. 2.

FIG. 1 is a perspective view of a plate carrier 1 that is used for receiving a license plate 2 (see FIGS. 2 and 3). The plate carrier 1 can be arranged on a lead 3 (see FIGS. 6A and 6B) in order to thus attach the license plate 2 to the lead 3, for example in order to label the lead 3 or to mark the lead 3 with information that is important for the lead 3 or for an installation connected to the lead 3.

It should be noted at this point that a plate carrier 1 of the type described here can in principle also be attached to other objects, for example installation housings or the like. In this respect, the plate carrier 1 is not limited to fastening a license plate 2 to a lead 3.

The plate carrier 1 comprises a carrier body 10, on the sides of which guide rails 11, 12 are arranged. The carrier body 10 comprises a support surface 100 on which a license plate 2 rests in a planar manner when said plate is placed in position on the plate carrier 1, such that the support surface 100 provides defined contact for the license plate 2.

The support surface 100 extends in a support plane A. The guide rails 11, 12 project from the support surface 100 perpendicularly to the support plane A and extend so as to be mutually parallel such that the support surface 100 is laterally delimited by the guide rails 11, 12.

The guide rails 11, 12 each comprise a guide bar 110, 120 on an edge remote from the support surface 100, which guide bars define a form-fitting engagement for a license plate 2. A license plate 2 can be pushed in between the guide rails 11, 12 in an insertion direction E such that, in a position in which the license plate 2 is arranged on the plate carrier 1, the license plate 2 comes to rest between the guide rails 11, 12 and is held on the plate carrier 1, perpendicularly to the support surface 100, by means of the guide bars 110, 120 (see FIGS. 2 and 3).

Two latching elements 13, 14 are arranged on the support surface 100, which elements are cut out from the support surface 100 in the manner of snap-in tongues by means of slit-shaped openings 101. The latching elements 13, 14 are each connected to the support surface 100 by means of a web 130, 140, and extend in the insertion direction E in the manner of tongues. In this case, the latching elements 13, 14 are resilient perpendicularly to the support surface 100 on account of the webs 130, 140 thereof.

Each latching element 13, 14 has a latching projection 131, 141. In the position arranged on the plate carrier 1, the latching projections 131, 141 receive the license plate 2 therebetween such that the license plate 2 is secured on the plate carrier 1 against movement in the insertion direction E (see FIG. 2). In this case, each latching projection 131, 141 comes into contact with an edge 23, 24 of the license plate 2 that extends transversely to the guide rails 11, 12, such that the license plate 2 is thereby held between the latching projections 131, 141 in a form-fitting manner.

In addition to the latching projection 131, 141, a fastening position 132, 142 is arranged on the latching elements 13, 14 in each case which makes it possible for a rivet joint 18 to be attached, as shown in FIG. 3. The license plate 2 can be additionally secured to the carrier body 10 by means of a rivet joint 18 of this kind.

Furthermore, as shown schematically in FIG. 1, an elevation 133, 143 is arranged on each latching element 13, 14, which elevation projects from the support plane A provided by the support surface 100. When the license plate 2 is placed in position on the plate carrier 1, the elevations 133, 143 of the latching elements 13, 14 are in contact with the underside 25 (see FIG. 5A) of the license plate 2 from below, such that the license plate 2 presses against the guide bars 110, 120 of the guide rails 11, 12 perpendicularly from below by means of the elevations 133, 143, and in this way an initial stress is applied to the license plate 2 which secures the license plate 2 on the plate carrier 1 so as not to clatter and so as to have zero clearance.

Figure 5A:
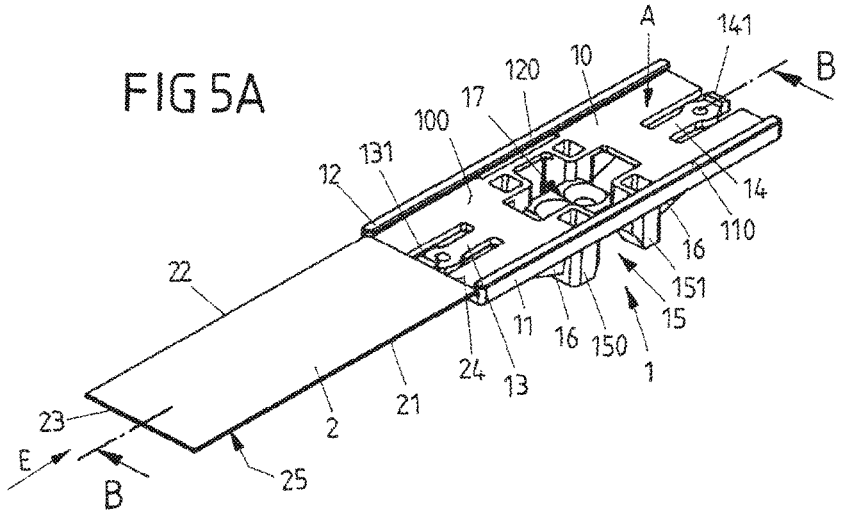
FIG. 5A is a perspective view of the plate carrier when the license plate is being placed in position.
Figure 5B:
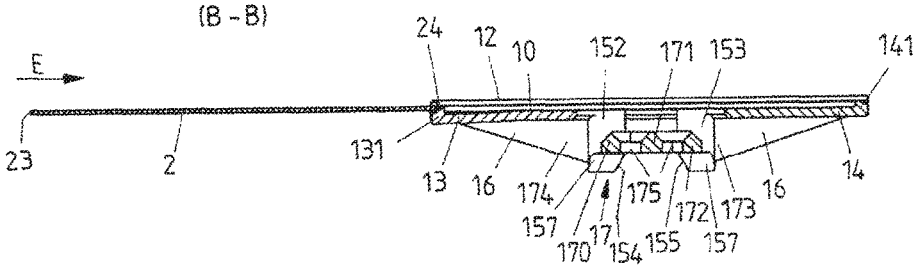
FIG. 5B is a cross section along the line B-B according to FIG. 5A.

For the purpose of positioning, the license plate 2 is placed in position on the plate carrier 1, as shown in FIGS. 5A and 5B, and the lateral edges 21, 22 thereof are pushed between the guide rails 11, 12 from one side in the insertion direction E. The front transverse edge 24 of the license plate 2 thus comes into contact with the latching projection 31 of the latching element 13 on the side of the plate carrier 1 from which the license plate 2 is pushed into the plate carrier 1. As a result, the license plate 2 strikes the latching projection 131 and forces the latching element 13 aside such that the license plate 2 can be pushed between the guide rails 11, 12, over the latching projection 131.

When the license plate 2 has been completely pushed into the plate carrier 1, the latching projection 131 of the latching element 13 comes into contact, in a latching manner, with the rear transverse edge 23, such that the transverse edges 23, 24 of the license plate 2 are received between the latching projections 131, 141 of the latching elements 13, 14, and the lateral edges 21, 22 of said license plate are additionally held between the lateral guide rails 11, 12.

In order to release the license plate 2 from the plate carrier 1, one of the latching elements 13, 14 can be resiliently bent so as to disengage from the associated transverse edge 23, 24 of the license plate 2, such that the license plate 2 can be pushed out of engagement with the guide rails 11, 12, over the relevant latching element 13, 14. This is possible without using tools and in particular without deforming the license plate 2.

The plate carrier 1 comprises a positioning apparatus 15 that is formed by four peg-shaped positioning elements 150-153. The positioning elements 150-153 project on a side of the carrier body 10 remote from the support surface 100 and form a seat for a lead 3 on the plate carrier 1.

The positioning apparatus 15 comprises four positioning elements 150-153 in total, which elements extend so as to be mutually parallel and are arranged at corners of an (imaginary) square when viewed in a cross-sectional plane in parallel with the support plane A.

Figure 6A:
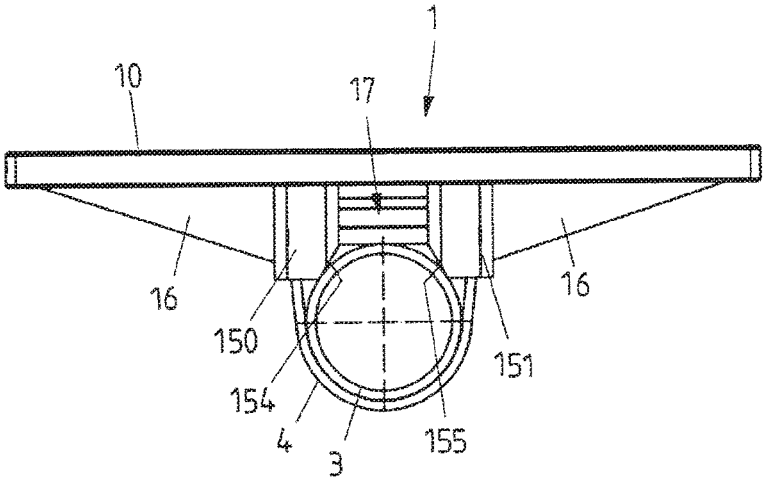
FIG. 6A is a side view of the plate carrier on a lead.
Figure 6B:
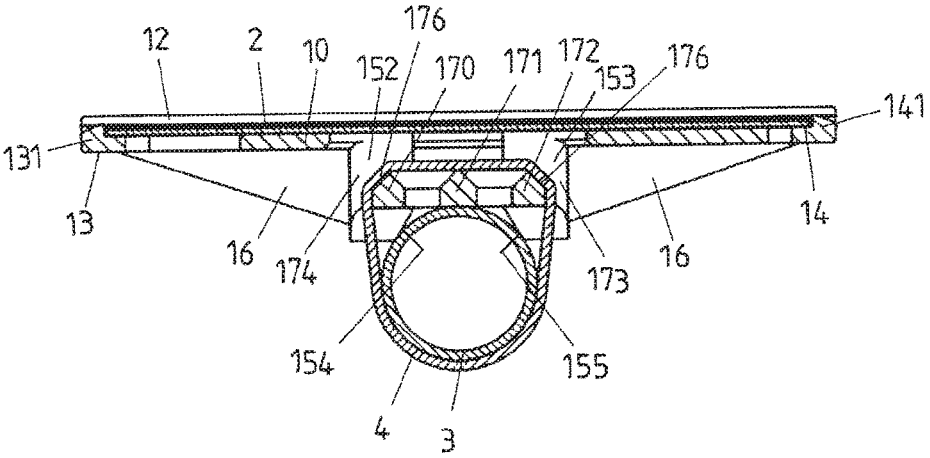
FIG. 6B is a cross section of the arrangement according to FIG. 6A, in accordance with the cutting line B-B according to FIG. 2.

The positioning elements 150-153 make it possible for the plate carrier 1 to be placed in position on a lead 3 in two different positions that are rotated by 90° with respect to one another. The support surface 100 of the plate carrier 1 can thus be placed in position transversely on a lead 3, as shown in FIGS. 6A and 6B. In this case, the positioning elements 150, 152 come to rest on one side of the lead 3 and the positioning elements 151, 153 come to rest on the other side of the lead 3, such that the lead is received between two pairs of positioning elements, 150, 152 and 151, 153.

Alternatively, the support surface 100 of the plate carrier 1 can be arranged in the longitudinal extension direction of the lead 3. In this case, the plate carrier is thus rotated by 90° with respect to the position according to FIGS. 6A and 6B, such that the positioning elements 150, 151 come to rest on one side of the lead 3 and the positioning elements 152, 153 come to rest on the other side of the lead 3.

In order to achieve a favorable fit of the lead 3 on the positioning elements 150-153, each positioning element 150-153 comprises two chamfers 154-157 in the form of bevels. The inside edges of the end of each positioning element 150-153 are beveled, such that a chamfer 154-157 of each positioning element 150-153 is in contact with the lead 3 when the plate carrier 1 is placed in position on a lead 3 (see FIGS. 6A and 6B).

Each positioning element 150-153 is supported on the carrier body 10 by means of a rib 16, so as to form a dimensionally stable unit. The plate carrier 1 additionally comprises a fastening apparatus 17 that is formed by webs 170-172 that extend between the positioning elements 150-153. There are openings 175 between the webs 170-172. In addition, openings 173, 174 are formed between the positioning elements 150-153 and the carrier body 10.

A fastening element 4, for example in the form of a cable tie, can be laid around the webs 170-172, as shown in FIGS. 6A and 6B. The webs 170-172 each have chamfers on the edges thereof, so as to provide favorable contact of the fastening element 4 on in particular the outer webs 170, 172. The beveled design of the webs 170-172 results in low-wear contact of the fastening element 4 on the webs 170-172.

When fastened, the fastening element 4 extends around the lead 3 and one or more of the webs 170-172, as shown in FIGS. 6A and 6B. The plate carrier 1 is thus secured on the lead 3 by means of the fastening element 4.

The carrier body 10 is advantageously produced as a plastics molded part, for example by means of plastics injection molding.

The concept on which the invention is based is not limited to the embodiments described above, but instead can in principle also be implemented in entirely different manners.

In principle, it is sufficient to provide just one latching element on the plate carrier, such that a license plate can be pushed into the plate carrier just from one side.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

1 plate carrier
10 carrier body
100 support surface
101 slits
11, 12 guide rail
110, 120 guide bar
13, 14 latching element
130, 140 web
131, 141 detent
132, 142 fastening point
133, 143 elevation
15 positioning apparatus
150-153 positioning element (peg)
154-157 chamfer
16 rib
17 fastening apparatus
170-172 web
173-175 opening
176 chamfer
18 rivet joint
2 license plate
21-24 edge
25 underside
3 lead
4 fastening element
A support plane
E insertion direction

The invention claimed is:

1. A plate carrier for carrying a license plate, comprising:
a carrier body;
two guide rails that are arranged on the carrier body and extend so as to be mutually parallel, and between which the license plate is configured be pushed in an insertion direction in order to be arranged on the plate carrier, the license plate being held between the guide rails when arranged on the plate carrier; and
at least one resilient latching element that is arranged on the carrier body and that is configured to be deformed elastically when the license plate is being arranged on the plate carrier, and that secures the license plate on the carrier body against movement in the insertion direction when the license plate is arranged on the plate carrier.

2. The plate carrier according to claim 1, wherein the at least one resilient latching element comprises two latching elements that are arranged on the carrier body so as to be offset from one another in the insertion direction.

3. The plate carrier according to claim 2, wherein the two latching elements are configured to receive the license plate therebetween when the license plate is arranged on the plate carrier.

4. The plate carrier according to claim 1, wherein the carrier body comprises a support surface that extends in a support plane and on which the license plate rests when arranged on the plate carrier.

5. The plate carrier according to claim 4, wherein the at least one latching element is connected to the support surface of the carrier body by a web.

6. The plate carrier according to claim 4, wherein the at least one latching element comprises a latching projection that projects from the support surface transversely to the support plane and is configured such that an edge thereof comes into contact with the license plate when the license plate is arranged on the plate carrier.

7. The plate carrier according to claim 4, wherein the at least one latching element comprises an elevation that projects from the support surface and that is configured to come into contact, when the license plate is arranged on the plate carrier, with an underside of the license plate that faces the support surface.

8. A plate carrier for carrying a license plate, comprising:
a carrier body;
two guide rails that are arranged on the carrier body and extend so as to be mutually parallel, and between which the license plate is configured be pushed in an insertion direction in order to be arranged on the plate carrier, the license plate being held between the guide rails when arranged on the plate carrier;
at least one resilient latching element that is arranged on the carrier body and that is configured to be deformed elastically when the license plate is being arranged on the plate carrier, and that secures the license plate on the carrier body against movement in the insertion direction when the license plate is arranged on the plate carrier; and
a positioning apparatus, by which the plate carrier is configured to be placed in position on a lead, the positioning apparatus comprising at least two positioning elements that project from the carrier body and the ends of which remote from the carrier body are configured to be placed in position on the lead.

9. The plate carrier according to claim 8, wherein the at least two positioning elements each comprise a chamfer at the ends thereof remote from the carrier body, which chamfers are configured to be brought into contact with the lead during positioning on the lead.

10. The plate carrier according to claim 8, wherein the positioning apparatus comprises four peg-shaped positioning elements that extend so as to be mutually parallel and that project from the carrier body.

11. The plate carrier according to claim 10, wherein the positioning elements define two positions, rotated by 90° with respect to one another, in which the plate carrier is configured to be placed in position on the lead.

12. The plate carrier according to claim 10, wherein the four peg-shaped positioning elements are arranged relative to one another on the carrier body such that the positioning elements span a rectangle.

13. The plate carrier according to claim 10, wherein the four peg-shaped positioning elements each comprise two mutually offset chamfers at the ends thereof remote from the carrier body configured to place the plate carrier in position on the lead in different positions.

14. The plate carrier according to claim 10, wherein the four peg-shaped positioning elements are arranged relative to one another on the carrier body such that the positioning elements span a square.

15. A plate carrier for carrying a license plate, comprising:
a carrier body;
two guide rails that are arranged on the carrier body and extend so as to be mutually parallel, and between which the license plate is configured be pushed in an insertion direction in order to be arranged on the plate carrier, the license plate being held between the guide rails when arranged on the plate carrier; and
at least one resilient latching element that is arranged on the carrier body and that is configured to be deformed elastically when the license plate is being arranged on the plate carrier, and that secures the license plate on the carrier body against movement in the insertion direction when the license plate is arranged on the plate carrier,
wherein the at least one latching element comprises a fastening point configured to fasten the license plate to the carrier body.

16. A plate carrier for carrying a license plate, comprising:
a carrier body;
two guide rails that are arranged on the carrier body and extend so as to be mutually parallel, and between which the license plate is configured be pushed in an insertion direction in order to be arranged on the plate carrier, the license plate being held between the guide rails when arranged on the plate carrier;
at least one resilient latching element that is arranged on the carrier body and that is configured to be deformed elastically when the license plate is being arranged on the plate carrier, and that secures the license plate on the carrier body against movement in the insertion direction when the license plate is arranged on the plate carrier; and
a fastening apparatus comprising at least one web, around which a fastening element configured to fasten the plate carrier to a lead is configured to be laid, the at least one web comprising at least one chamfer as a contact surface for the fastening element.

* * * * *